US005108056A

United States Patent [19]

McBounds

[11] Patent Number: 5,108,056

[45] Date of Patent: Apr. 28, 1992

[54] SAFETY HOLDER FOR FABRIC PRESSING IRON

[76] Inventor: Derrick McBounds, 11927 Ohio St., Detroit, Mich. 48204

[21] Appl. No.: 586,997

[22] Filed: Sep. 24, 1990

[51] Int. Cl.[5] ..... D06F 79/02

[52] U.S. Cl. ..... 248/117.4

[58] Field of Search ..... 248/117.1, 117.2, 117.3, 248/117.4, 117.6, 117.7

[56] References Cited

U.S. PATENT DOCUMENTS

| | | | |
|---|---|---|---|
| 1,759,214 | 5/1930 | Winters | 248/117.1 |
| 2,599,941 | 6/1952 | Rickles | 248/117.3 |
| 2,950,889 | 8/1960 | Farrow | 248/117.4 |
| 3,062,492 | 11/1962 | Hedger | 248/117.1 |

FOREIGN PATENT DOCUMENTS

| | | | |
|---|---|---|---|
| 492505 | 2/1930 | Fed. Rep. of Germany | 248/117.3 |
| 689546 | 4/1953 | United Kingdom | 248/117.4 |

*Primary Examiner*—Carl D. Friedman
*Assistant Examiner*—Derek J. Berger
*Attorney, Agent, or Firm*—John R. Benefiel

[57] ABSTRACT

A safety holder for a fabric pressing iron including an inclined platform supported on a stand and baseplate, with a retractable spring urged pusher element engaging the heel of the iron and urging the iron forward beneath inwardly inclined retention walls to be held against lift off. The iron hot surfaces are completely encased within the platform and side walls.

11 Claims, 2 Drawing Sheets

SAFETY HOLDER FOR FABRIC PRESSING IRON

BACKGROUND OF THE INVENTION

This invention concerns fabric pressing irons of the type commonly found in most households. In ordinary use, when the hot iron is set down for a moment to reposition the item being ironed or to obtain another item to be pressed, it is placed in an upright position on the heel of the iron body and balanced with the rear of the handle so that the hot sole plate is positioned vertically so as to not burn the ironing pad.

This balanced position is somewhat precarious and the iron easily upset, particularly since the presence of a draped electrical cord increases the chances that the hot iron will be tipped over. Many burn injuries have resulted from such accidents.

There have heretofore been developed relatively stable iron holders, but many of these have been designed for storage rather than for providing a safety holder for convenient momentary use during ironing.

A stabilized iron holder for use during ironing is described in U.S. Pat. No. 3,162,415 but that design is only somewhat more stable in that the iron can easily be pulled out from the holder.

Furthermore that holder, being of metal, creates exposed hot surfaces on the holder, and some of the hot surfaces of the iron itself remain exposed.

Thus, there is a need for a holder which more stably supports the iron and more completely protects against bodily contact with hot surfaces.

Such iron holder should be able to be very conveniently used since a great many handlings of the iron are necessary as a person presses the typical load of ironing.

Dissipation of the heat from the hot iron and protection of the surface on which the iron is supported must also be provided by the holder design.

SUMMARY OF THE INVENTION

The present invention comprises a safety holder for a fabric pressing iron, securely retaining a hot iron which is readily emplaced therein. The holder includes a pointedly shaped platform preferably supported at a slightly upwardly tipped angle from the horizontal. A retention feature at the front of the platform is comprised of inwardly inclined walls extending from the tip and along each side of the edges of the platform, preventing the iron from lifting from the platform when the iron is forced forwardly into a holding position beneath the walls. The inwardly inclined retention walls and platform together substantially enclose the hot surfaces of the iron to protect against burns.

The iron is pushed into the holding position by a movable pusher element near the rear of the platform, urged, as by an attached tension spring, towards the front end of the platform. The pusher element able to be readily retracted to a rearward position by engagement of the heel of the iron, allowing the iron to be inserted within the retention walls and thereafter advanced by spring force into the holding position.

The pusher element is also preferably inclined slightly downwardly to engage the rear edge of the iron, preventing lift off of the rear of the iron, so that the iron is very securely held both at its front and rear.

The platform is constructed to resist the heat of the iron and a thin walled platform stand and base is designed to minimize heat transmission to the supporting surface.

The holder may be strapped to an ironing board, while the iron itself may be secured to the holder with a second strap when stored.

DETAILED DESCRIPTION

Figure 1:
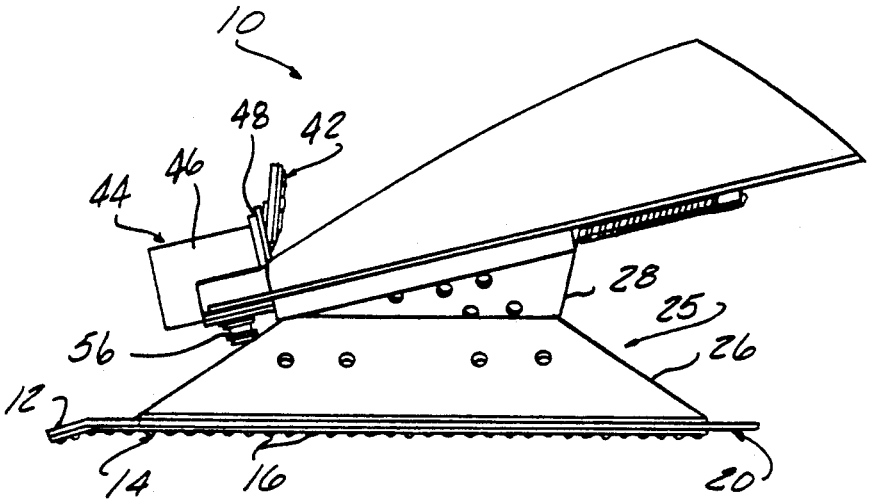
FIG. 1 is a side elevational view of the pressing iron holder according to the present invention.
Figure 2:
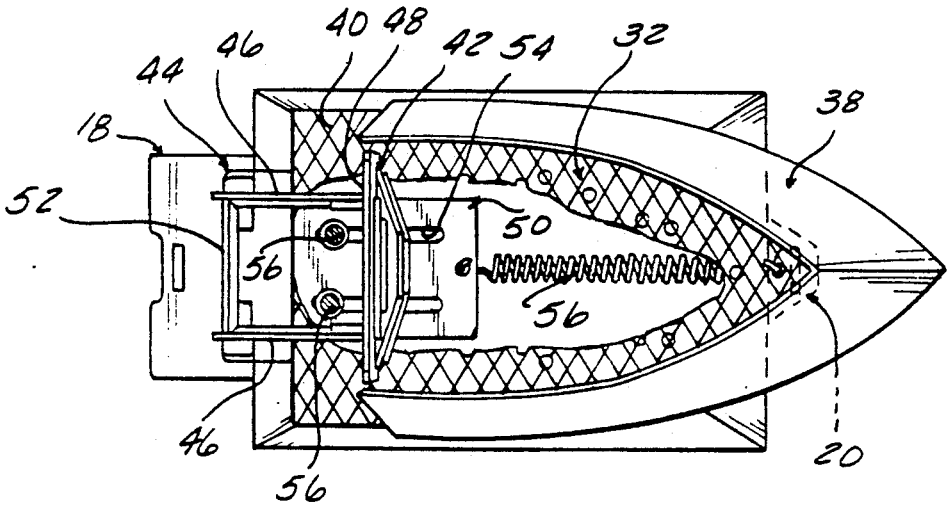
FIG. 2 is a plan view of the iron holder shown in FIG. 1, partially broken away.
Figure 3:
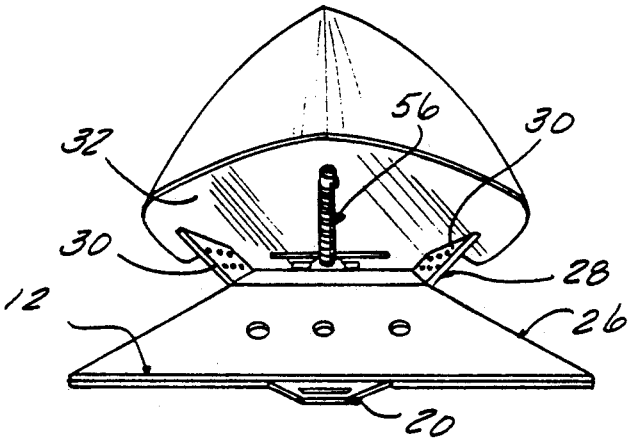
FIG. 3 is a front view of the iron holder shown in FIGS. 1 and 2.

In the following detailed description, certain specific terminology will be employed for the sake of clarity and a particular embodiment described in accordance with the requirements of 35 USC 112, but it is to be understood that the same is not intended to be limiting as the invention is capable of taking many forms and variations within the scope of the appended claims.

Referring to the drawings, the holder 10 includes a planar base plate 12 to which is mounted a nonskid bottom layer 14 having a pattern of protrusions 16 intended to provide a frictional positioning of the holder 10 on a supporting surface. Slotted projections 18, 20 at the front and rear provide a point of connection for a strap ends 22 adapted to encircle an ironing board 24 (FIG. 5) to secure the holder 10 thereon. A Velcro (TM) securement or buckle may be used to secure the strap ends together.

Figure 4:
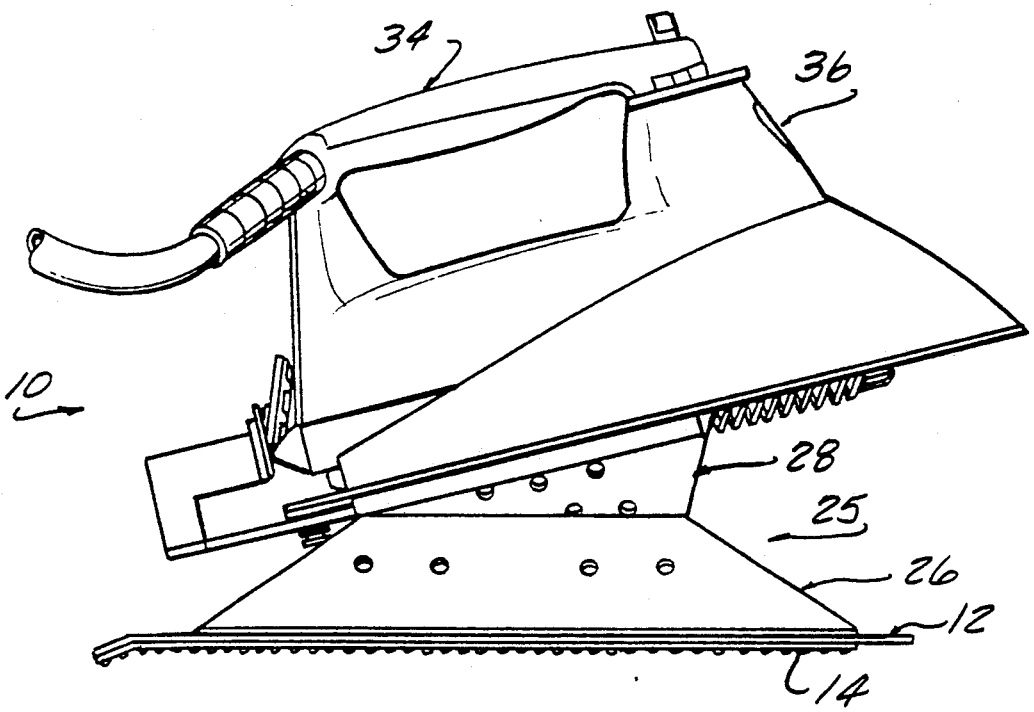
FIG. 4 is a side elevational view of the pressing iron holder shown in FIGS. 1–3, with an iron in holding position therein.

Attached to the plate 12 is a holder stand 25 formed of a sheet material, a lower portion shown as a truncated pyramid, and an upper portion 28 comprised of a pair of outwardly flaring pieces 30 having their upper sides sloping downwardly toward the rear of the holder 10. A platform 32 is fixed to these upper edges so as to also slope downwardly toward the rear at a moderate angle to the plate 12, i.e., on the order of 15 degrees so as to orient the handle 34 of a pressing iron conveniently for grasping (FIG. 4), and to prevent the escape of water from steam irons.

The platform 32 is formed with side edges converging to a point at the forward end to be of a generally conforming shape to the sole plate of a pressing iron, and has attached to the perimeter thereof inwardly inclined retention walls 38, the walls 38 extending uninterruptedly from the platform tip along either side of the platform 32 to the rear thereof. The overhang of the walls 38 above the platform 32 provides a retention feature for the pressing iron 36, preventing lifting off when the iron is advanced therein to its forwardmost position on the platform 32.

The platform 32 and walls 38 substantially completely enclose the hot sole plate and peripheral edges of the iron to encase the same, providing effective protection against burns.

The upper surface of the platform 32 carries a heat resistant layer, as a sheet of expanded metal 40.

The platform 32 and upper and lower portions of the holder stand 25 are perforated to improve dissipation of heat. The holder 10 is preferably constructed of high temperature resistant molded plastic.

A pusher element 42 is provided at the rear of the platform 30 at a height so as to engage the back edge of the iron 30. The pusher element 42 is inclined forwardly from being normal to the platform 32 so as to create a slight wedging action, thus trapping the back edge of the iron against lift off from the platform 32.

The pusher element 42 is supported on a U-shaped bracket 44, having upper segments 46 extending forwardly over the rear of the platform 32 in a bracket plate 48 attached to the rear of the pusher element 42. A lower bracket plate 50 is connected to the upper segments 46 by an end plate 52 at the rear of the bracket 44. The lower bracket plate 50 extends forwardly and has a pair of slots 54 extending parallel to the longitudinal axis. Fixed pins or screws 56 carried in threaded holes in the platform 32 are received in the slots 54 to provide a guide means for constraining movement of the pusher element 42 along the fore and aft direction.

A tension spring 56 is attached at one end to the front of the bracket lower plate 50, and at the other end hooked to the forward end of the platform 32 so as to urge the bracket 44 forwardly, causing the pusher element 42 to be forced to its advanced position.

The pusher element 42 extends substantially entirely across the rear edge of the sole plate of the iron, and is of adequate height to block touching of the hot rear edge of the iron, contributing to the protective encasement function described above.

In use, the heel of the iron is caused to engage the pusher element 42 to enable it to be retracted sufficiently to allow the pressing iron to be lowered onto the platform 32. After release, the tension spring 56 forces the iron beneath the walls 38 and its rear edge wedged beneath the inclined pusher element 42 to firmly grip the iron in the holder 10 (FIG. 5).

The iron is securely encased so that if the entire assembly of iron and holder is dropped, contact with a hot surface is still unlikely, even if a person attempts to catch the holder and iron. Thus, it is less critical to secure the holder to the ironing board then with other designs.

The iron thus cannot easily be dislodged and is securely positioned during intervals between uses. At the same time, the iron can be emplaced in the holder 10 with only the slightest motion which is very easily executed due to the favorable inclination of the platform 32.

Figure 5:
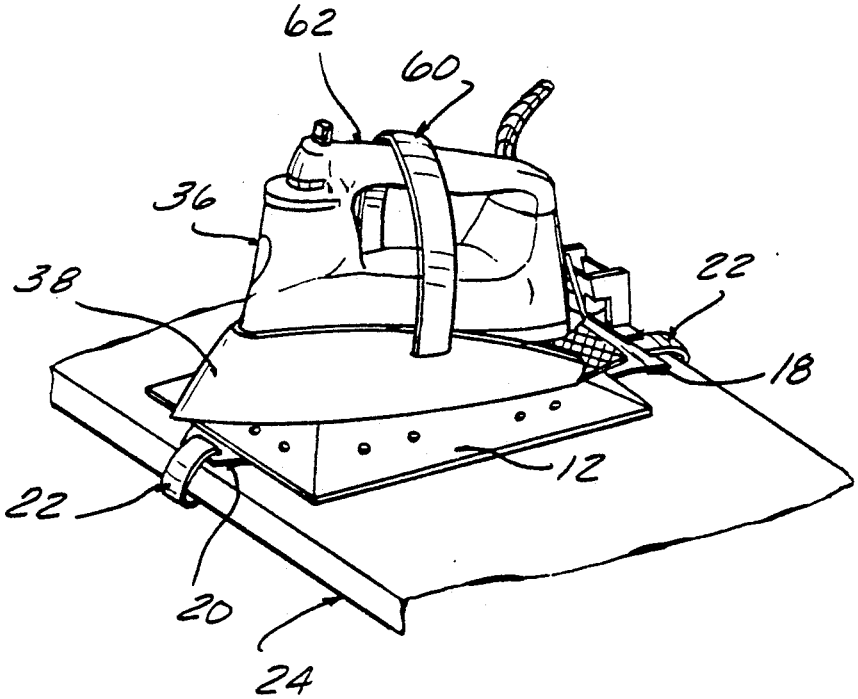
FIG. 5 is a perspective view of the pressing iron holder of FIGS. 1–3 with an iron strapped in holding position therein, together with a fragmentary view of adjacent portions of an ironing board to which the pressing iron holder is strapped.

An additional holding strap 60 may be anchored in the wall 38 and passed over (or through) the handle 62 of the iron 36 for more permanent storage, as seen in FIG. 5.

I claim:

1. A safety holder for a fabric pressing iron having a sole plate with side edges extending between a forward end and a rear end of said sole plate, said safety holder comprising:

a support platform comprising a member having an upper planar surface, a forward end, a rear end, and a pair of sides extending from said forward end to said rear end;

a retention feature on said platform adapted to receive the forward end of said iron therebeneath when said iron is positioned on said platform, said retention feature securing the forward end of said iron from lifting off said platform when in position;

said platform sides converging to a tip comprising said forward end, and wherein said retention feature comprising inwardly inclined side walls extending back along either side of said platform from said tip, said inclination of said sidewalls trapping said side edges of said iron sole plate when pushed into said tip;

said sidewalls uninterrupted and extending substantially entirely along said platform and sufficiently high to completely encase the side edges of the sole plate of said iron;

pusher means including a pusher element mounted above the rear end of said platform;

guide means mounting said pusher element for movement in a fore and aft direction, and bias means for urging said pusher element towards a forward position to thereby provide a pushing force urging an iron forward on said platform to be held beneath said retention feature.

2. The safety holder according to claim 1 further including a base plate adapted to rest on a planar support surface; and a holder stand attached to the base plate and projecting upwardly therefrom and wherein said platform is attached to said stand so as to lie at a moderate angle above the horizontal, with one end above another end thereof.

3. The safety holder according to claim 2 wherein said base plate is formed with spaced slots, and strap means anchored in said slots for securement of said holder to an ironing board.

4. The safety holder according to claim 1 wherein said pusher element is inclined from the vertical so as to wedge against the rear end of an iron on said platform.

5. The safety holder according to claim 1 wherein said pusher element extends substantially across said rear end of said platform and projecting above said rear end of said platform to shield contact with the rear end of the sole plate of an iron resting on said platform.

6. The safety holder according to claim 1 wherein said stand and said platform are formed of perforated sheet material.

7. The safety holder according to claim 1 wherein said platform is covered with a layer of expanded metal.

8. The safety holder according to claim 1 wherein said guide means includes a bracket having an upper elongated segments extending above said platform and a lower slotted bracket plate extending below said platform and fixed guide pins extending through said slot.

9. The safety holder according to claim 8 wherein said bias means comprises a tension spring connected at one end to said bracket plate and at the other end to said platform at the forward end thereof.

10. The safety holder according to claim 1 wherein said pusher element extends substantially completely across the rear end of said platform to shield against contact with the rear edge of the sole plate of an iron on said platform.

11. A safety holder for a fabric pressing iron having a sole plate having a bottom surface, a rear edge, and side edges converging to a tip, said safety holder comprising:

a support platform comprising a member having an upper planar surface configured with sides and rear and forward ends, said sides converging to a tip at the forward end of said platform and said platform rear end extending across said sides to have the shape of the sole plate of said iron;

an inwardly inclined pair of retention walls extending along either side of said platform to said rear end to completely encase the bottom surface and side edges of an iron positioned thereon said platform and walls constructed of a non-metallic material to shield against contact with high temperature iron surfaces;

an element mounted to extend above said platform adjacent the rear end thereof;

bias means for urging said element and said pair of retention walls towards each other to thereby provide a pushing force urging an iron forward on said platform to be held beneath said inwardly inclined pair of retention walls.

* * * * *